US007114416B2

(12) United States Patent
Hasegawa

(10) Patent No.: US 7,114,416 B2
(45) Date of Patent: Oct. 3, 2006

(54) ROTATIVELY OPERATING TOOL FOR ROTATIVELY OPERATED MEMBER HAVING A PAIR OF ENGAGING SURFACES

(75) Inventor: Yoshihisa Hasegawa, Sayama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/540,366

(22) PCT Filed: Dec. 22, 2003

(86) PCT No.: PCT/JP03/16482

§ 371 (c)(1),
(2), (4) Date: Jun. 23, 2005

(87) PCT Pub. No.: WO2004/058454

PCT Pub. Date: Jul. 15, 2004

(65) Prior Publication Data

US 2006/0130616 A1 Jun. 22, 2006

(30) Foreign Application Priority Data

Dec. 24, 2002 (JP) ..... 2002-372850

(51) Int. Cl.
*B25B 13/28* (2006.01)

(52) U.S. Cl. ..... 81/98; 81/97; 81/99; 81/100

(58) Field of Classification Search ..... 81/97, 81/98, 99, 100
See application file for complete search history.

(56) References Cited

U.S. PATENT DOCUMENTS 1,395,052 A * 10/1921 Miller ..... 81/99

D287,928 S * 1/1987 Watanabe ..... D8/22

(Continued)

FOREIGN PATENT DOCUMENTS

EP 0 913 895 A2 5/1999

(Continued)

*Primary Examiner*—Joseph J. Hail, III
*Assistant Examiner*—Shantese McDonald
(74) *Attorney, Agent, or Firm*—Standley Law Group LLP

(57) ABSTRACT

In a rotatively operating tool, a lever (5) having a head (4) at its tip end is turnably connected to a handle (6) provided at its tip end with a lower jaw (12). The head (4) is provided with an upper jaw (7) brought into engagement with an engaging surface (2*a*) of a bolt head (2). A spring (14) is mounted between the lever (5) and the handle (6) for biasing the lever (5) to turn it in a direction of abutment of a stopper face (11) of the lever (5) against the handle (6). When the handle (6) is turned in one direction, the lower jaw (12) at the tip end of the handle (6) is brought into abutment against an engaging surface (2*b*) of the bolt head (2), whereby the bolt head (2) is clamped between the lower jaw (12) and the upper jaw (7). When the handle (6) is turned in an opposite direction, it is brought into a state in which the clamping of the bolt head (2) is canceled. Even when the lever (5) is turned against a biasing force of the spring (14), the bolt head (2) is clamped between the upper jaw (7) and the lower jaw (12). Thus, it is possible to provide a rotatively operating tool having a simple structure, which is designed so that a rotatively operated member such as a bolt can be rotated in one direction and even in an opposite direction as required by the reciprocally turning operation of the tool.

12 Claims, 5 Drawing Sheets

U.S. PATENT DOCUMENTS 5,746,097 A * 5/1998 McCann ..... 81/99

FOREIGN PATENT DOCUMENTS

| | | |
|---|---|---|
| JP | 51-149499 | 5/1975 |
| JP | 52-56695 | 10/1975 |
| JP | 57-197470 | 6/1981 |
| JP | 61-16277 | 1/1986 |
| JP | 07-186058 | 7/1995 |
| JP | 11-138455 | 5/1999 |

* cited by examiner

ROTATIVELY OPERATING TOOL FOR ROTATIVELY OPERATED MEMBER HAVING A PAIR OF ENGAGING SURFACES

FIELD OF THE INVENTION

The present invention relates to a rotatively operating tool for rotatively operating a rotatively operated member having an operated portion provided with engaging surfaces forming a pair at a distance of 180° in a circumferential direction at the operated portion, such as a hexagon headed bolt, a hexagon nut or a shaft hexagonal in section.

BACKGROUND ART

In general, a wrench is used for the rotative operation of a rotatively operated member having an operated portion as described above. In a case of a usual wrench, however, it is required that the wrench is once removed from the rotatively operated member every time the rotatively operated member is rotated over a certain angle and thereafter, the wrench be caught again on another engaging surface of the operated portion of the rotatively operated member. This operation is troublesome and especially, the wrench is not suitable for a long-time operation. Therefore, a special tool of a ratchet type is also used which is designed so that when a handle is turned in one direction, a rotatively operated member is rotated, but when the handle is turned in an opposite direction, a rotatively operating force is not transmitted to the rotatively operated member. However, such special tool can rotate the rotatively operated member only in one direction and for this reason, when the rotatively operated member is to be rotated in an opposite direction, it is necessary to recatch the tool with an opposite orientation each time. It is desired in many cases that the rotatively operated member, after being rotated in one direction, is rotated in an opposite direction. For example, in a case of a rotatively operated member such as a tie rod of an automobile, the adjustment of the length of the rotatively operated member is carried out by the rotation of the latter and hence, it is necessary to rotate the rotatively operated member in opposite directions for the fine adjustment. In such a case, the operation is rather complicated with the tool for rotating the rotatively operated member only in one direction as described above.

From such viewpoint, an improved wrench has been proposed (see Patent Document 1, for example), which is designed so that a rotatively operated member can be rotated in a desired direction by the reciprocally turning operation in a range of relatively small angles, while ensuring that a rotatively operating force in any direction can be applied to the rotatively operated member. In the improved wrench, a stationary jaw and a movable jaw are provided at a tip end of a handle grasped by an operator, so that when an operated portion of the rotatively operated member is located between the stationary jaw and the movable jaw and the handle is pushed to the operated portion, the movable jaw is turned to a position where the operated portion of the rotatively operated member is clamped between the movable jaw and the stationary jaw, and when the pushing force to the handle is weakened, the movable jaw is turned from the clamping position to an unclamping position.

[Patent Document 1]

Japanese Patent No.2913251

However, the wrench described in Patent Document 1 has a problem that a means is required for detecting a state in which the handle has been pushed to the operated portion of the rotatively operated member, inevitably resulting in an increase in number of parts, an increase in cost and moreover, an increase in weight.

DISCLOSURE OF THE INVENTION

The present invention has been accomplished with such circumstances in view, and it is an object of the present invention to provide a rotatively operating tool having an extremely simple structure, wherein while ensuring that a rotatively operated member is rotated in one direction, the rotatively operated member can be also rotated in an opposite direction, as required, by the reciprocally turning operation of the tool.

To achieve the above object, according to a first aspect and feature of the present invention, there is provided a rotatively operating tool for a rotatively operated member having a pair of engaging surfaces, the tool rotatively operating the rotatively operated member having an operated portion provided with engaging surfaces forming a pair at a distance of 180° in a circumferential direction at the operated portion, and comprising a lever integrally provided with a hook-shaped head having, at a tip end thereof, an upper jaw capable of being brought into engagement with one of the pair of the engaging surfaces of the operated portion of the rotatively operated member, and a handle which is provided at a tip end thereof with a lower jaw capable of being brought into engagement with the other of the pair of the engaging surfaces, and is grasped at a base end thereof and turned by an operator, wherein the lever is connected at an intermediate portion thereof to the handle for turning movement in directions in which the upper jaw is moved toward and away from the lower jaw, so that when the upper jaw at the tip end of the lever is brought into engagement with one of the pair of engaging surfaces of the operated portion of the rotatively operated member and the handle is turned relative to the lever in the direction in which the lower jaw is moved toward the upper jaw, the lower jaw protrudes toward the upper jaw to abut against the other of the pair of engaging surfaces, whereby the operated portion of the rotatively operated member is clamped between the lower jaw and the upper jaw, and when the handle is turned in an opposite direction, the handle is brought into abutment against a stopper face formed on the lever, whereby the lever is turned along with the handle.

The terms "upper jaw" and "lower jaw" are merely used for the purpose of distinguishing them from each other, and do not indicate a vertical positional relationship.

With the first feature, when hook-shaped head provided at the tip end of the lever is caught on the operated portion of the rotatively operated member and the handle is pulled in this state, the upper jaw provided on the head is brought into engagement with one of the engaging surfaces of the operated portion, and the handle is turned relative to the lever, whereby the lower jaw provided at the tip end of the handle is brought into abutment against the other of the engaging surfaces of the operated portion. Therefore, the operated portion is clamped between the upper jaw and the lower jaw, and if the handle is turned, as it is, in the direction in which the lower jaw approaches the upper jaw, the rotatively operated member is also rotated in the same direction. When the handle is turned in the opposite direction, the lower jaw is disengaged from the engaging surface of the operated portion, whereby the clamping of the operated portion is canceled, and the handle is brought into abutment against the stopper face of the lever to apply a turning force to the lever. Therefore, the lever is slid on an outer peripheral surface of the operated portion without applying a rotatively operating force to the operated portion. In this manner, the rotatively operated member is rotated in one direction by the reciprocally turning operation of the handle.

When the rotatively operated member is to be rotated in the opposite direction, the operator grasps the end of the lever opposite from the head along with the handle. Then, the handle is turned relative to the lever, whereby the lower jaw provided at the tip end of the handle is brought into abutment against the engaging surface of the operated portion and as a result, the operated portion is clamped between the upper jaw and the lower jaw. Therefore, if the handle is turned, as it is, in the opposite direction, the rotatively operated member is also rotated in the same direction.

In this way, with the rotatively operating tool having the first feature of the present invention, the rotatively operated member, while being able to be rotated in one direction, can be also rotated in the opposite direction, as required, by the reciprocally turning operation of the tool. With the tool, the lever need only be turnably connected to the handle and hence, the tool has an extremely simple stricture and can be produced at low cost.

According to a second aspect and feature of the present invention, in addition to the first feature, a spring is mounted between the handle and the lever for biasing the lever to turn the latter in a direction of abutment of the handle against the stopper face of the lever.

With the second feature, when no force is applied to the lever, the lever is held in a given position relative to the handle. Therefore, the head provided at the tip end of the lever can be easily caught on the operated portion of the rotatively operated member, and when the operator has released his hand from the lever grasped along with the handle by the operator, the lever is returned to a predetermined position, and the lower jaw provided at the tip end of the handle is automatically disengaged from the engaging surface of the operated portion. Therefore, the subsequent operation is easy.

According to a third aspect and feature of the present invention, in addition to the second feature, the spring is in the form of a plate made of an elastic material and mounted between an end of the lever opposite from the head and an intermediate portion of the handle.

With the third feature, even if there is a foreign matter existing in the vicinity of the operated portion of the rotatively operated member, the foreign matter is prevented from being put between the handle and the lever. Therefore, it is possible to achieve the reliable turning movement of the lever.

BEST MODE FOR CARRYING OUT THE INVENTION

The mode for carrying out the present invention will now be described by way of an embodiment with reference to the accompanying drawings.

Figure 1:
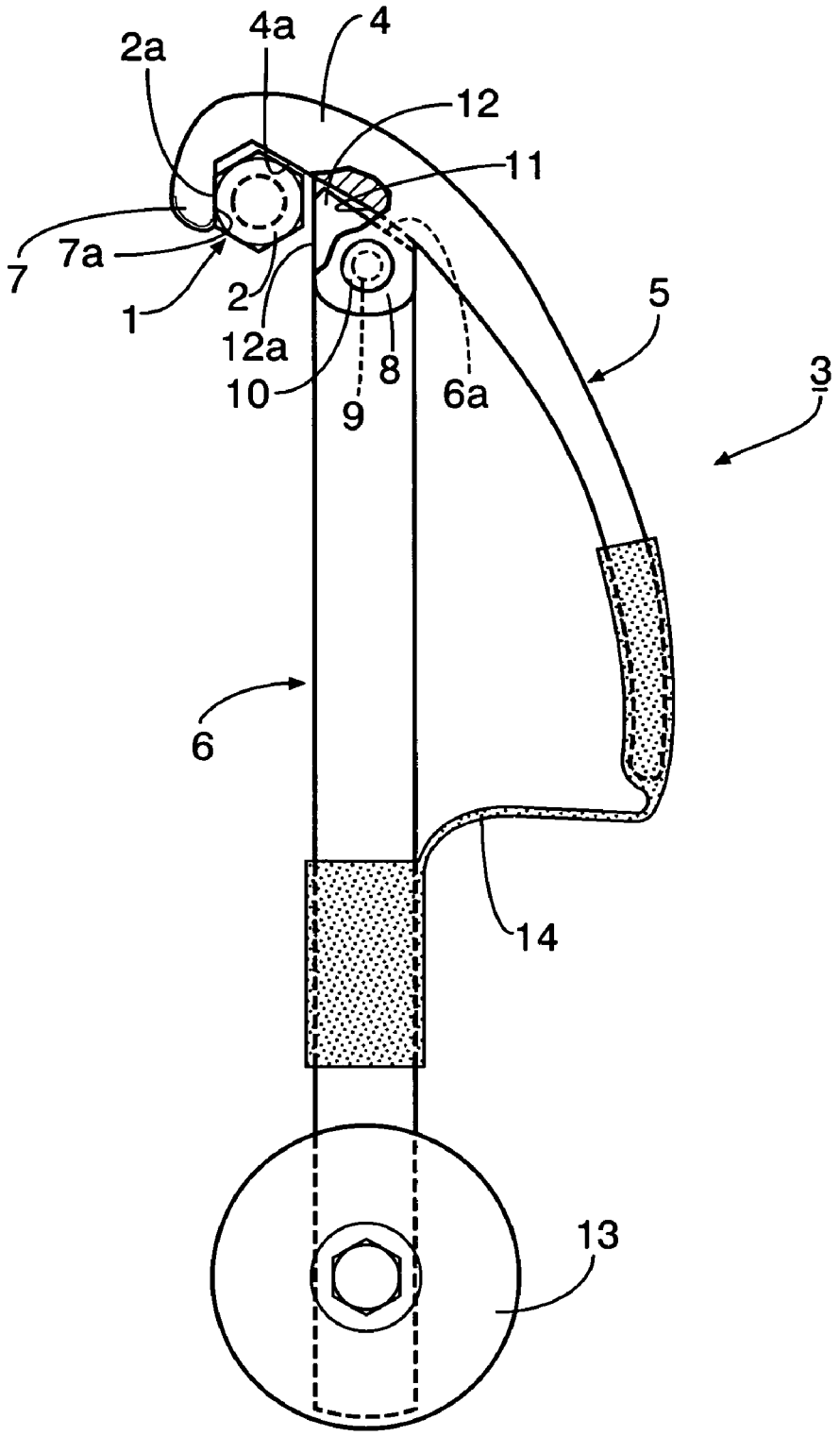
FIG. 1 is a side view showing a tool according to one embodiment of the present invention, which rotates a bolt as a rotatively operated member.

Referring first to FIG. 1, a bolt 1 which is one example of a rotatively operated member is provided with a bolt head 2 as an operated portion for rotation of the bolt 1. The bolt head 2 is of a substantially regular hexagonal shape and has three sets of engaging surfaces 2*a* and 2*b* forming pairs at distances of 180° in a circumferential direction. A rotatively operating tool 3 according to the present invention is intended to rotate a rotatively operated member such as the bolt 1 by rotatively operating an operated portion such as the bolt head 2.

The rotatively operating tool 3 includes a lever 5 having a head 4 integrally provided at its tip end, and a handle 6 grasped at its base end and turned by an operator. The head 4 of the lever 5 is of a hook-shape and has an upper jaw 7 formed at its tip end and having an inner surface 7*a* which is capable of being brought into engagement with one 2*a* of the engaging surfaces 2*a* and 2*b*. An inner surface 4*a* of the base end of the head 4 is formed to form an angle of approximately 600 with respect to the inner surface 7*a* of the upper jaw 7.

The lever 5 has a bearing plate 8 integrally formed thereon in the vicinity of the base end of the head 4 to protrude from the inner surface 4*a* of the head 4. A bearing bore 9 is made in the bearing plate 8, and a lever pin 10 perpendicular to the lever 5 is inserted through the bearing bore 9. The handle 6 is connected at a location slightly displaced from a tip end face 6*a* of the handle 6 to the base end for turning movement relative to the lever 5 by virtue of the lever pin 10. A stopper face 11 is formed at a portion of the lever 5, which is opposed to the tip end face 6*a* of the handle 6.

A lower jaw 12 is formed at a tip end of the handle 6 ahead of an area of fitting of the lever pin 10, so that a left face 12*a* of the lower jaw 12 as viewed in FIG. 1 is brought into engagement with the other 2*b* of the engaging surfaces 2*a* and 2*b* of the bolt head 2, when the handle 6 is turned in a counterclockwise direction in FIG. 1. A grip 13 is mounted to the base end of the handle 6 and grasped by an operator to facilitate a usual operation.

A spring 14 is mounted between the handle 6 and the lever 5 for biasing the lever 5 to turn the lever 5 in the counterclockwise direction in FIG. 1. Therefore, in usual, the lever 5 is held in a state in which the stopper face 11 of the lever 5 is in abutment against the tip end face 6*a* of the handle 6. The spring 14 is in the form of a hollow hose made from an elastic material such as a resin, and has opposite ends fitted over and fixed at an intermediate portion of the handle 6 and an end of the lever 5 opposite from the head 4, respectively. The intermediate portion of the spring 14 is formed into a plate shape by squashing it.

In this manner, the spring 14 of the plate shape is laid between the free end of the lever 5 and the handle 6, thereby ensuring that when an electric wire or the like is disposed in the vicinity of the bolt 1, the electric wire or the like cannot be interposed between the lever 5 and the handle 6 and hence, the damage to the electric wire or the like is prevented and the sufficient turning of the lever 5 is ensured.

The operation of this embodiment will be described below.

As described above, the lever 5 is held by the spring 14 in the state in which the stopper face 11 of the lever 5 is in abutment against the tip end face 6*a* of the handle 6. Therefore, as shown in FIG. 1 an area between the upper jaw 7 at the tip end of the lever 5 and the lower jaw 12 at the tip end of the handle 6 is open.

Figure 2:
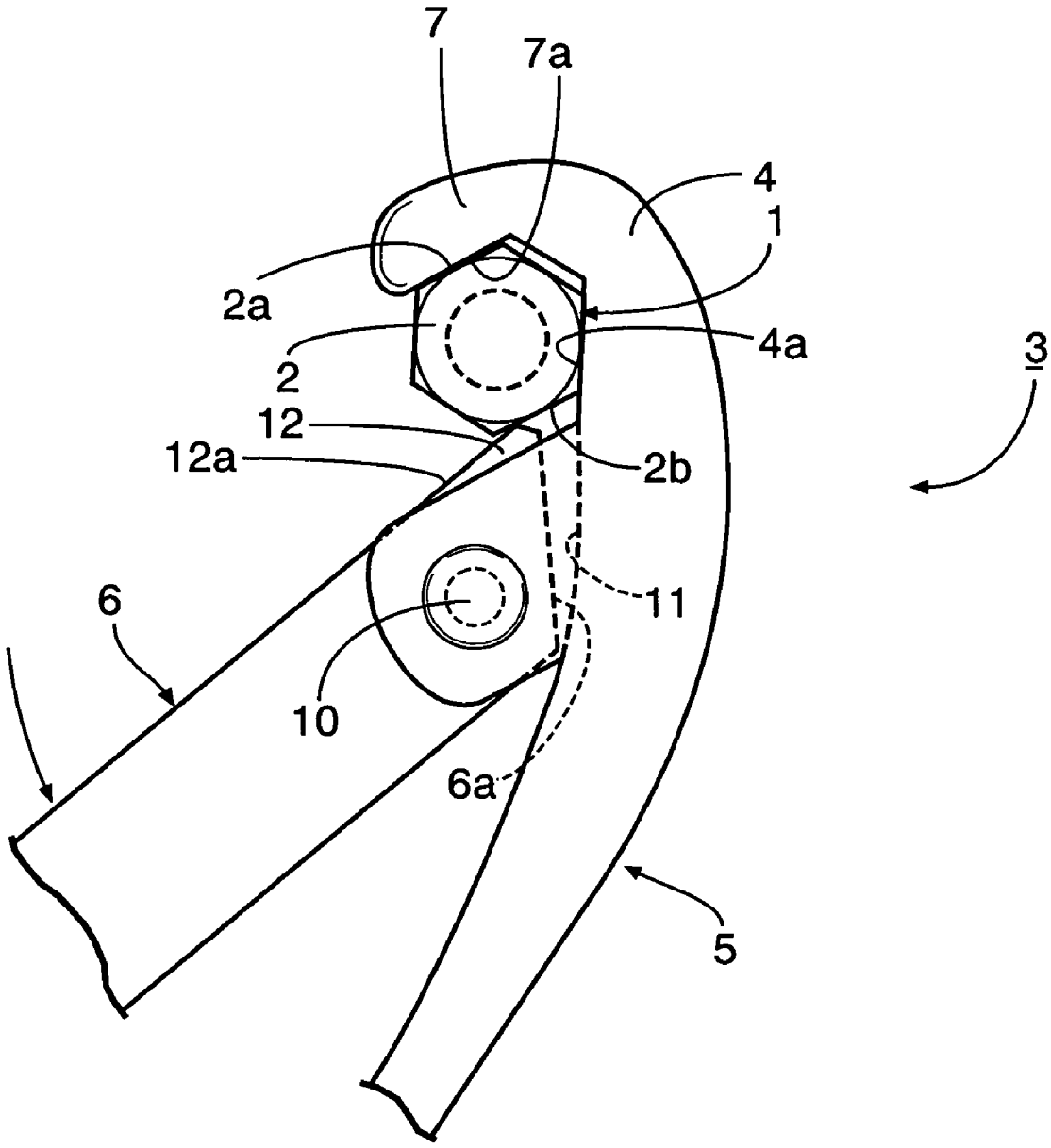
FIG. 2 is a view for explaining the operation, showing a state when a bolt head is clamped from the state shown in FIG. 1.
Figure 3:
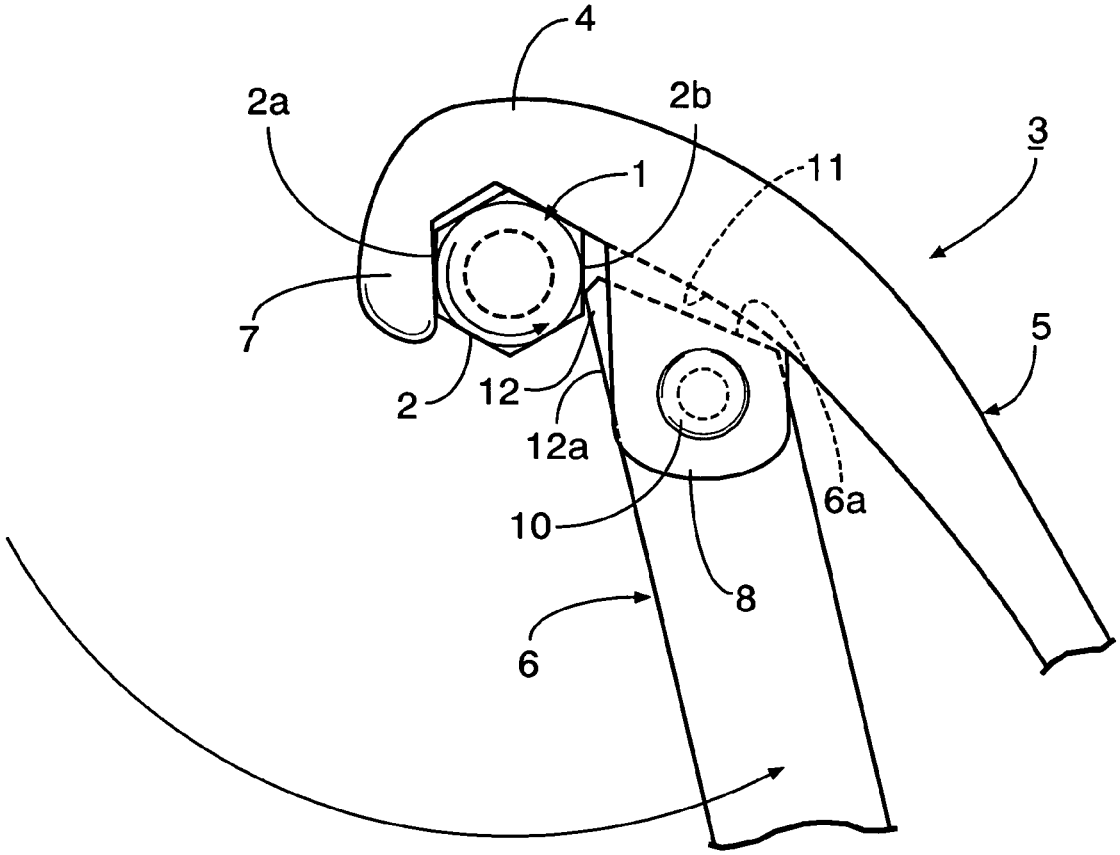
FIG. 3 is a view for explaining the operation, showing a state when the handle has been turned in one direction from the state shown in FIG. 2 to rotate the bolt head.

Thus, the handle 6 is operated by grasping the grip 13 and pulled downwards in FIG. 1, so that the bolt head 2 is moved into between the upper jaw 7 and the lower jaw 12. Then, the head 4 at the tip end of the lever 5 is caught on the bolt head 2, whereby the lever 5 is turned in a clockwise direction about the head 4. Thus, the inner surface 7*a* of the upper jaw 7 at the tip end of the head 4 is brought into engagement with one 2*a* of the engaging surfaces 2*a* and 2*b* of the bolt head 2, and the inner surface 4*a* of the base end of the head 4 is brought into the other engaging surface of the bolt head 2, whereby the lever 5 is substantially fixed. On the other hand, the handle 6 is turned in the counterclockwise direction relative to the lever 5 about the lever pin 10 by turning the lever 5 in the clockwise direction. As a result, as shown in FIG. 2, the lower jaw 12 at the tip end of the handle 6 protrudes toward the upper jaw 7, and the left face 12*a* of the lower jaw 12 is brought into abutment against the other 2*b* of the engaging surfaces 2*a* and 2*b* of the bolt head 2. Namely, the bolt head 2 is clamped between the upper jaw 7 and the lower jaw 12. Therefore, if the handle 6 is turned in the counterclockwise direction shown by an arrow in such state, the bolt head 2 is clamped more strongly and rotated along with the handle 6 in the counterclockwise direction as shown by an arrow in FIG. 3, whereby the bolt 1 is loosened.

Figures 4A, 4B, 4C, 4D:
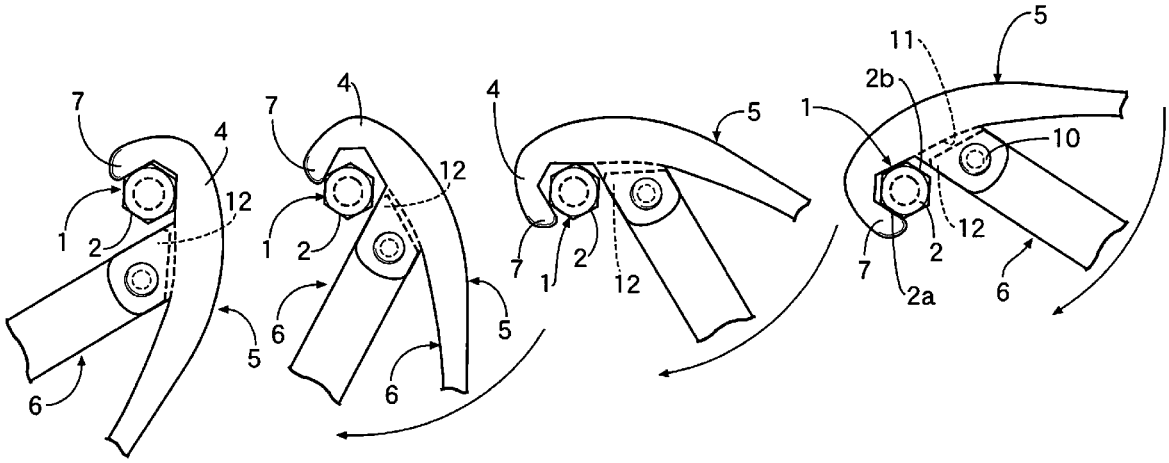
FIGS. 4A to 4D are views for explaining the operation, sequentially showing states when the handle is turned from the state shown in FIG. 3 in an opposite direction.

After the bolt 1 is rotated over a given angle in this manner, the handle 6 is turned in the clockwise direction. Then, the lower jaw 12 at the tip end of the handle 6 is disengaged from the engaging surface 2*b* of the bolt head 2, whereby a clearance is formed between the bolt head 2 and the handle 6. Namely, the clamping of the bolt head 2 is canceled. The lever 5 and the handle 6 are held in a state in which the tip end face 6*a* of the handle 6 is in abutment against the stopper face 11 of the lever 5. Thereupon, the handle 6 is further turned in the clockwise direction in such state kept intact, as shown by an arrow in FIG. 4A. This causes the lever 5 to be also turned in the clockwise direction in unison with the handle 6. At this time, the clamping of the bolt head 2 has been canceled as described above. Therefore, even if the lever 5 is turned as described above, the head 4 at the tip end of the lever 5 is only slid along an outer peripheral surface of the bolt head 2, as shown in FIGS. 4B and 4C, and provides no rotatively operating force to the bolt head 2. When the handle 6 is turned in the clockwise direction in the manner described above, the bolt 1 is not rotated and held in the original rotated position.

When the handle 6 is returned to an initial position, the upper jaw 7 is brought into a state in which it is in engagement with the engaging surface 2*a* of the bolt head 2, as shown in FIG. 4D. When the handle 6 is turned from such state in the counterclockwise direction, the bolt head 2 is rotated in the counterclockwise direction in a manner similar to that described above, whereby the bolt 1 is loosened.

In this manner, the bolt head 2 is rotated in one direction, e.g., only in the counterclockwise direction in this embodiment by reciprocally turning the handle 6. During this time, the tool 3 may remain caught on the bolt head 2, and the engaging surface on which the tool 3 is caught need not be changed to the different engaging surface 2*a* or 2*b* of the bolt head 2 every time the bolt 1 is rotated over a given angle, as is a usual wrench.

Figure 5:
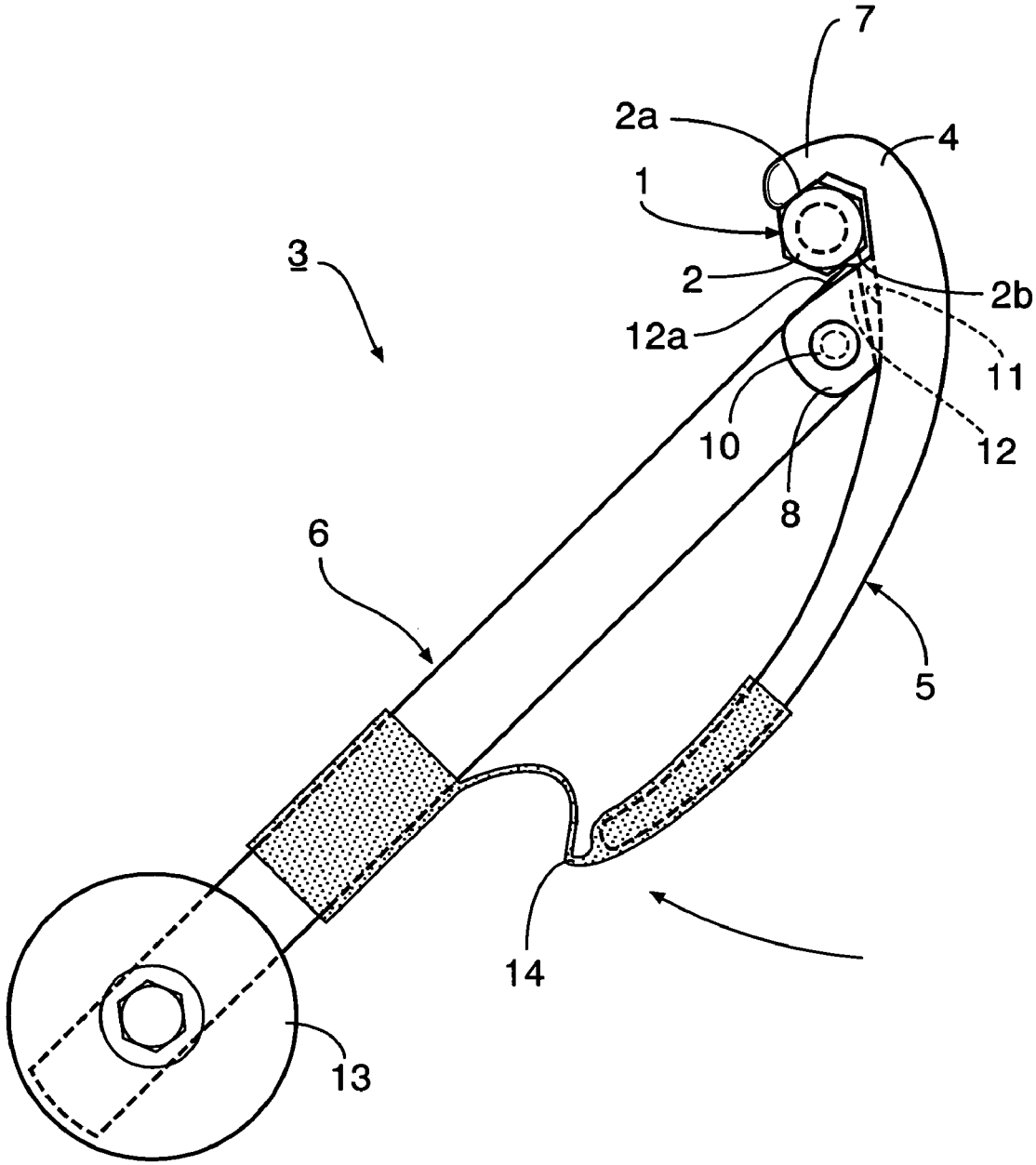
FIG. 5 is a view for explaining the operation, showing a state when the lever has been grasped along with the handle in the state shown in FIG. 1.

When the bolt 1 has been excessively loosened, the operator releases his hand from the grip 13 and regrasps the handle 6, and more specifically, grasps the end of the lever 5 having the spring 4 mounted thereto, along with the handle 6. Then, the lever 5 is turned relative to the handle 6, as shown by an arrow in FIG. 5 and as a result, the lower jaw 12 at the tip end of the handle 6 protrudes toward the upper jaw 7 at the tip end of the lever 5, whereby the bolt head 2 is clamped between the upper jaw 7 and the lower jaw 12. Therefore, if the handle 6 is turned in the clockwise direction in such state, the bolt head 2 is also turned in the clockwise direction, whereby the bolt 1 is tightened. In this state, the bolt head 2 can be rotated even in the counterclockwise direction. Namely, the tool 3 can be used, just like the usual wrench, by grasping the lever 5 along with the handle 6. Even at this time, the tool 3 need not be recaught on the bolt head 2.

The embodiment has been described above with regard to the operative operation of the bolt 1 by the rotatively operating tool 3 according to the present invention. However, the tool 3 can be used to rotatively operate not only the bolt 1 having the hexagonal bolt head 2, but also a polygonal shaft such as a square nut and a tie rod of an automobile or a member or the like having a rotatively operated portion formed flatly by cutting opposite sides of a shaft circular in section. Especially, the tool 3 is suitable for the rotative operation of the rotatively operated member which must be operated from below in a narrow space, as is the tie rod of the automobile.

It will be understood that the present invention is not limited to the above-described embodiment, and various modifications in design may be made without departing from the subject matter of the invention defined in claims. For example, the spring 14 is not limited to the form of the hollow hose as in the above-described embodiment and can be a leaf spring made of a thin metal plate.

What is claimed is:

1. A rotatively operating tool for manipulating a rotatively operated member having a pair of opposed engaging surfaces located on an operated portion thereof, said tool rotatively operating the rotatively operated member by acting against said opposed engaging surfaces, and comprising, a lever integrally provided with a hook-shaped head having, at a tip end thereof, an upper jaw capable of being brought into engagement with one of the pair of opposed engaging surfaces of the operated portion of said rotatively operated member, and a handle connected to an intermediate portion of said lever, said handle provided at a tip end thereof with a lower jaw capable of being brought into engagement with the other of the pair of opposed engaging surfaces of the operated portion of said rotatively operated member, said handle grasped at a base end thereof and turned by an operator, wherein said tool is adapted for turning movements that result in the upper jaw being moved toward and away from the lower jaw, respectively, such that after the upper jaw at the tip end of the lever is brought into engagement with one of the pair of opposed engaging surfaces of the operated portion of said rotatively operated member and said handle is turned relative to said lever in a first direction, said lower jaw is moved toward said upper jaw to abut against the other of the pair of opposed engaging surfaces, whereby the operated portion of said rotatively operated member is clamped between said lower jaw and said upper jaw, and when said handle is turned in an opposite direction, said lower jaw is moved away from the other of the pair of opposed engaging surfaces and said handle is brought into abutment against a stopper face formed on said lever, whereafter said lever is turned along with said handle.

2. A rotatively operating tool according to claim 1, further comprising a spring mounted between said handle and said lever for biasing said lever to turn said lever in a direction of abutment of said handle against the stopper face of said lever.

3. A rotatively operating tool according to claim 2, wherein said spring is in the form of plate made of an elastic material and is mounted between an end of the lever opposite from the head and an intermediate portion of the handle.

4. A rotatively operating tool according to claim 2, wherein said spring is formed from a hollow elastic hose that has been at least partially flattened.

5. A rotatively operating tool according to claim 2, wherein said spring is a leaf spring made of a metallic material.

6. A rotatively operating tool according to claim 2, wherein by simultaneously grasping both a lower end of said lever and said handle, said biasing caused by said spring is overcome and said lever is instead moved toward said handle such that said lower jaw is moved toward said upper jaw to abut against the other of the pair of opposed engaging surfaces, whereby the operated portion of said rotatively operated member is clamped between said lower jaw and said upper jaw and may be rotated in either a clockwise or counterclockwise direction.

7. A rotatively operating tool according to claim 1, wherein said lower jaw is formed at least partially by a side face of said handle at said tip end thereof.

8. A rotatively operating tool according to claim 1, further comprising a grip mounted near a base end of said handle.

9. A rotatively operating tool according to claim 8, wherein said grip is a knob.

10. A rotatively operating tool according to claim 1, further comprising an inner surface on said hook-shaped head of said lever, said inner surface contacting, during rotation of said rotatively operated member, an engaging surface of the operated portion of said rotatively operated member that resides intermediate said opposed engaging surfaces.

11. A rotatively operating tool according to claim 1, further comprising a bearing plate extending from said intermediate portion of said lever for connection of said handle.

12. A rotatively operating tool according to claim 11, further comprising a lever pin passing through a bore in said bearing plate and said handle.

* * * * *

UNITED STATES PATENT AND TRADEMARK OFFICE

CERTIFICATE OF CORRECTION

PATENT NO. : 7,114,416 B2
APPLICATION NO. : 10/540366
DATED : October 3, 2006
INVENTOR(S) : Hasegawa It is certified that error appears in the above-identified patent and that said Letters Patent is hereby corrected as shown below:

In column 4, line 29, please delete “600” and insert --60°--.

Signed and Sealed this

Fifth Day of December, 2006

JON W. DUDAS
*Director of the United States Patent and Trademark Office*